US009127549B2

(12) United States Patent
Lacy et al.

(10) Patent No.: US 9,127,549 B2
(45) Date of Patent: Sep. 8, 2015

(54) TURBINE SHROUD COOLING ASSEMBLY FOR A GAS TURBINE SYSTEM

(75) Inventors: Benjamin Paul Lacy, Greer, SC (US); David Edward Schick, Greenville, SC (US); David Wayne Weber, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 340 days.

(21) Appl. No.: 13/456,407

(22) Filed: Apr. 26, 2012

(65) Prior Publication Data

US 2013/0287546 A1 Oct. 31, 2013

(51) Int. Cl.

| | |
|---|---|
| ***F01D 11/08*** | (2006.01) |
| ***F01D 5/00*** | (2006.01) |
| ***F01D 5/08*** | (2006.01) |
| ***F01D 25/14*** | (2006.01) |
| ***F01D 25/26*** | (2006.01) |
| ***F01D 5/22*** | (2006.01) |
| ***F01D 25/12*** | (2006.01) |

(52) U.S. Cl.

CPC .. *F01D 5/00* (2013.01); *F01D 5/08* (2013.01); *F01D 5/084* (2013.01); *F01D 5/225* (2013.01); *F01D 25/12* (2013.01); *F01D 25/14* (2013.01); *F01D 25/26* (2013.01); *F05D 2260/201* (2013.01); *F05D 2260/204* (2013.01)

(58) Field of Classification Search

CPC ..... F01D 11/08; F01D 11/12; F01D 11/122; F01D 11/125; F01D 11/24; F01D 25/12; F01D 25/14; F01D 25/26; F05D 2260/201; F05D 2260/204

USPC ..... 415/115, 116, 173.1, 173.2, 175–178, 415/173.4, 173.5

See application file for complete search history.

(56) References Cited

U.S. PATENT DOCUMENTS

| | | | |
|---|---|---|---|
| 4,988,266 | A | 1/1991 | Nakamura et al. |
| 5,169,287 | A | 12/1992 | Proctor et al. |
| 5,957,657 | A | 9/1999 | Akita et al. |
| 6,223,524 | B1 | 5/2001 | Durcan |
| 6,461,108 | B1 | 10/2002 | Lee et al. |
| 6,528,118 | B2 | 3/2003 | Lee et al. |
| 6,679,680 | B2 | 1/2004 | Um et al. |
| 6,899,518 | B2 | 5/2005 | Lucas et al. |

(Continued)

FOREIGN PATENT DOCUMENTS

| | | | |
|---|---|---|---|
| EP | 0516322 | A1 | 12/1992 |
| EP | 1930550 | A2 | 6/2008 |
| EP | 2434106 | A2 | 3/2012 |

OTHER PUBLICATIONS

Search Report from EP Application No. 13165262.0 dated Dec. 4, 2013.

*Primary Examiner* — Christopher Verdier

(57) ABSTRACT

A turbine shroud cooling assembly for a gas turbine system includes an outer shroud component disposed within a turbine section of the gas turbine system and proximate a turbine section casing, wherein the outer shroud component includes at least one airway for ingesting an airstream. Also included is an inner shroud component disposed radially inward of, and fixedly connected to, the outer shroud component, wherein the inner shroud component includes a plurality of microchannels extending in at least one of a circumferential direction and an axial direction for cooling the inner shroud component with the airstream from the at least one airway.

16 Claims, 4 Drawing Sheets

(56) References Cited

U.S. PATENT DOCUMENTS

| | | | | |
|---|---|---|---|---|
| 7,284,954 | B2 | 10/2007 | Parker et al. | |
| 7,487,641 | B2 | 2/2009 | Frechette et al. | |
| 7,597,533 | B1 * | 10/2009 | Liang | 415/116 |
| 7,653,994 | B2 | 2/2010 | Dasilva et al. | |
| 7,740,442 | B2 | 6/2010 | Lee et al. | |
| 7,900,458 | B2 | 3/2011 | James et al. | |
| 2002/0106457 | A1 | 8/2002 | Lee et al. | |
| 2005/0232752 | A1 | 10/2005 | Meisels | |
| 2006/0140753 | A1 * | 6/2006 | Romanov et al. | 415/173.1 |
| 2007/0025837 | A1 | 2/2007 | Pezzetti et al. | |
| 2007/0205189 | A1 | 9/2007 | Grossklaus, Jr. et al. | |
| 2008/0166225 | A1 * | 7/2008 | Strangman et al. | 415/173.4 |
| 2009/0031564 | A1 | 2/2009 | Meier | |
| 2009/0053045 | A1 | 2/2009 | Nowak et al. | |
| 2009/0255117 | A1 | 10/2009 | Hovel et al. | |
| 2011/0236188 | A1 * | 9/2011 | Knapp et al. | 415/173.1 |
| 2012/0034075 | A1 * | 2/2012 | Hsu et al. | 415/178 |
| 2012/0036858 | A1 | 2/2012 | Lacy et al. | |
| 2012/0057969 | A1 | 3/2012 | Jiang et al. | |
| 2012/0076650 | A1 | 3/2012 | Akiyama et al. | |
| 2012/0114912 | A1 | 5/2012 | Bunker et al. | |

* cited by examiner

TURBINE SHROUD COOLING ASSEMBLY FOR A GAS TURBINE SYSTEM

BACKGROUND OF THE INVENTION

The subject matter disclosed herein relates to gas turbine systems, and more particularly to turbine shroud cooling assemblies for such gas turbine systems.

In gas turbine systems, a combustor converts the chemical energy of a fuel or an air-fuel mixture into thermal energy. The thermal energy is conveyed by a fluid, often compressed air from a compressor, to a turbine where the thermal energy is converted to mechanical energy. As part of the conversion process, hot gas is flowed over and through portions of the turbine as a hot gas path. High temperatures along the hot gas path can heat turbine components, causing degradation of components.

Turbine shrouds are an example of a component that is subjected to the hot gas path and often comprises two separate pieces, such as an inner shroud and an outer shroud. The inner shroud and the outer shroud are typically made of two distinct materials that are loosely connected together. The loose connection may be accomplished by sliding the inner shroud onto a rail of the outer shroud or by clipping the inner shroud onto a rail of the outer shroud. Such an arrangement allows the outer shroud, which remains cooler during operation, to be of a less expensive material, but results in turbine shroud cooling flow leakage, based on allowance for significantly different growth rates between the hotter, inner shroud and the cooler, outer shroud.

BRIEF DESCRIPTION OF THE INVENTION

According to one aspect of the invention, a turbine shroud cooling assembly for a gas turbine system includes an outer shroud component disposed within a turbine section of the gas turbine system and proximate a turbine section casing, wherein the outer shroud component includes at least one airway for ingesting an airstream. Also included is an inner shroud component disposed radially inward of, and fixedly connected to, the outer shroud component, wherein the inner shroud component includes a plurality of microchannels extending in at least one of a circumferential direction and an axial direction for cooling the inner shroud component with the airstream from the at least one airway.

According to another aspect of the invention, a turbine shroud cooling assembly for a gas turbine system includes an outer shroud component disposed within a turbine section of the gas turbine system and proximate a turbine section casing. Also included is an inner shroud component disposed radially inward of the outer shroud component, wherein the inner shroud component includes a plurality of microchannels, wherein the outer shroud component and the inner shroud component are formed of a single material. Further included is an impingement plate having a plurality of perforations for directing air toward the plurality of microchannels.

According to yet another aspect of the invention, a turbine shroud cooling assembly for a gas turbine system includes an outer shroud component disposed within a turbine section of the gas turbine system and proximate a turbine section casing. Also included is an inner shroud component disposed radially inward of, and fixedly connected to, the outer shroud component, wherein the inner shroud component includes a plurality of microchannels for cooling the inner shroud component. Further included is an impingement plate having a plurality of perforations for directing air toward the plurality of microchannels.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
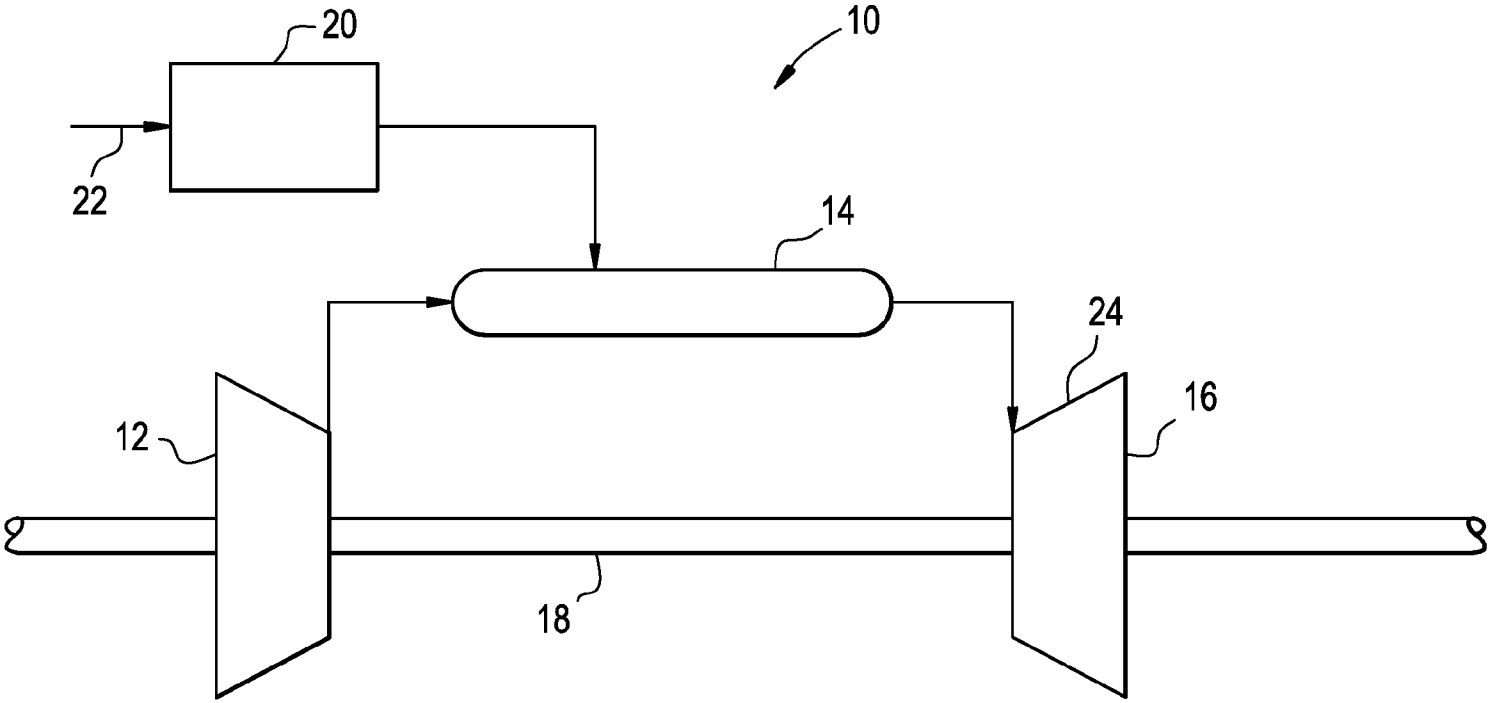
FIG. 1 is a schematic illustration of a gas turbine system.

Referring to FIG. 1, a gas turbine system is schematically illustrated with reference numeral 10. The gas turbine system 10 includes a compressor 12, a combustor 14, a turbine 16, a shaft 18 and a fuel nozzle 20. It is to be appreciated that one embodiment of the gas turbine system 10 may include a plurality of compressors 12, combustors 14, turbines 16, shafts 18 and fuel nozzles 20. The compressor 12 and the turbine 16 are coupled by the shaft 18. The shaft 18 may be a single shaft or a plurality of shaft segments coupled together to form the shaft 18.

The combustor 14 uses a combustible liquid and/or gas fuel, such as natural gas or a hydrogen rich synthetic gas, to run the gas turbine system 10. For example, fuel nozzles 20 are in fluid communication with an air supply and a fuel supply 22. The fuel nozzles 20 create an air-fuel mixture, and discharge the air-fuel mixture into the combustor 14, thereby causing a combustion that creates a hot pressurized exhaust gas. The combustor 14 directs the hot pressurized gas through a transition piece into a turbine nozzle (or "stage one nozzle"), and other stages of buckets and nozzles causing rotation of the turbine 16 within a turbine casing 24. Rotation of the turbine 16 causes the shaft 18 to rotate, thereby compressing the air as it flows into the compressor 12. In an embodiment, hot gas path components are located in the turbine 16, where hot gas flow across the components causes creep, oxidation, wear and thermal fatigue of turbine components. Controlling the temperature of the hot gas path components can reduce distress modes in the components and the efficiency of the gas turbine system 10 increases with an increase in firing temperature. As the firing temperature increases, the hot gas path components need to be properly cooled to meet service life and to effectively perform intended functionality.

Figure 3:
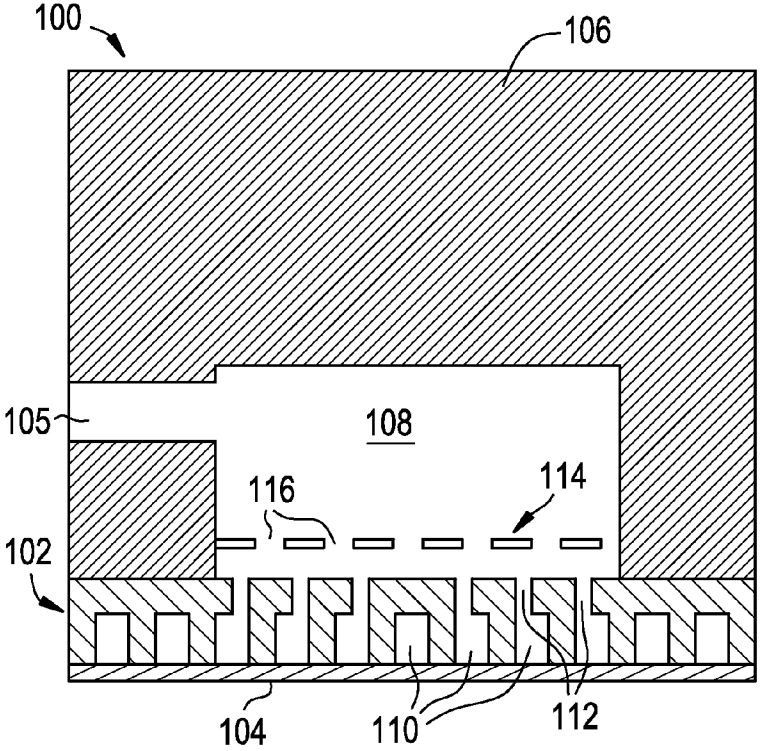
FIG. 3 is a turbine shroud cooling assembly of the first embodiment of FIG. 2, wherein the inner shroud component and the outer shroud component are made of a single material.
Figure 2:
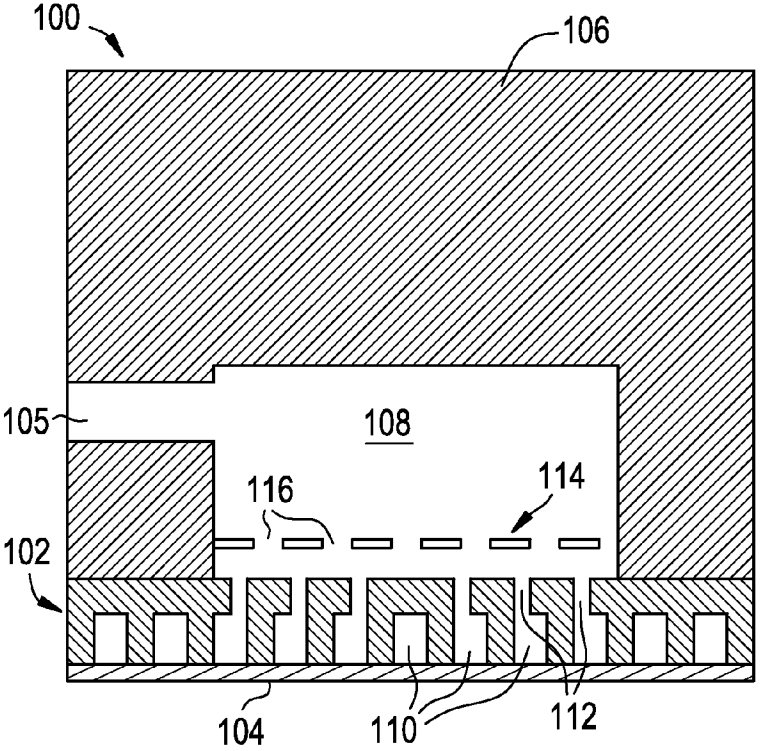
FIG. 2 is a turbine shroud cooling assembly of a first embodiment having an inner shroud component and an outer shroud component.

Referring to FIGS. 2 and 3, a cross-sectional view of a first embodiment of a turbine shroud cooling assembly 100 is shown. A shroud assembly is an example of a component disposed in the turbine 16 proximate the turbine casing 24 and subjected to the hot gas path described in detail above. The turbine shroud cooling assembly 100 includes an inner shroud component 102 with an inner surface 104 proximate to the hot gas path within the turbine 16. The turbine shroud cooling assembly 100 also includes an outer shroud component 106 that is generally proximate to a relatively cool fluid and/or air in the turbine 16. To improve cooling of the overall turbine shroud cooling assembly 100, at least one airway 105 is formed within the outer shroud component 106 for directing the cool fluid and/or air into the turbine shroud cooling assembly 100. Specifically, a plenum 108 within the outer shroud component 106 may be present to ingest and direct the cool fluid and/or air toward a plurality of microchannels 110 disposed within the inner shroud component 102. The inner surface 104 comprises a layer disposed proximate the plurality of microchannels 110, thereby enclosing the plurality of microchannels 110 to shield them from direct exposure to the hot gas path. The cover layer closest to the channel may comprise a sprayed on bond coat bridging the channel opening, a thin metal layer brazed or welded over one or more of the openings, or any other appropriate method to seal the microchannel(s). The layer may also comprise a thermal barrier coating ("TBC") and may be any appropriate thermal barrier material. For example, the TBC may be yttria-stabilized zirconia, and may be applied through a physical vapor deposition process or thermal spray process. Alternatively, the TBC may be a ceramic, such as, for example, a thin layer or zirconia modified by other refractory oxides such as oxides formed from Group IV, V and VI elements or oxides modified by Lanthanide series elements such as La, Nd, Gd, Yb and the like. The layer may range in thickness from about 0.4 mm to about 1.5 mm, however, it is to be appreciated that the thickness may vary depending on the specific application.

The inner shroud component 102 is fixedly connected to the outer shroud component 106, such that a direct, tight engagement is achieved. The connection may be made with a variety of available mechanical fasteners or processes, such as bolting, bonding, welding or brazing, for example. The fasteners and processes are merely for illustrative purposes and it is to be appreciated that any fastener or process may be employed that provides a direct, tight engagement between the inner shroud component 102 and the outer shroud component 106. Reduced leakage of cooling fluid and/or air from the turbine shroud cooling assembly 100 to the hot gas path improves cooling of the turbine shroud cooling assembly 100 and provides a higher temperature gas to convert from thermal energy to mechanical energy in the turbine 16. Such a reduction in leakage is accomplished with a flush connection between the inner shroud component 102 and the outer shroud component 106. The inner shroud component 102 and the outer shroud component 106 may be formed of two distinct materials (FIG. 2) or a single, uniform material (FIG. 3). A single, uniform material is enabled by adequate cooling of the turbine shroud cooling assembly 100, and more particularly adequate cooling of the inner shroud component 102.

Cooling of the outer shroud component 106 and the inner shroud component 102 is achieved by ingesting an airstream of the cooling fluid and/or air from a fluid supply (not illustrated), such as a chamber and/or a pump. The fluid supply provides the cooling fluid, which may include air, a water solution and/or a gas. The cooling fluid is any suitable fluid that cools the turbine components and selected regions of gas flow, such as high temperature and pressure regions of the turbine shroud cooling assembly 100. For example, the cooling fluid supply is a supply of compressed air from the compressor 12, where the compressed air is diverted from the air supply that is routed to the combustor 14. Thus, the supply of compressed air bypasses the combustor 14 and is used to cool the turbine shroud cooling assembly 100.

The cooling fluid flows from the fluid supply through the at least one airway 105 into the plenum 108 of the outer shroud component 106. Subsequently, the cooling fluid, or airstream, is directed into a plurality of microchannel feed holes 112 that lead to the plurality of microchannels 110. An impingement plate 114 disposed within the turbine shroud cooling assembly 100 includes a plurality of perforations 116 that provide an impingement cooling jet effect and impinges the cooling fluid toward the microchannel feed holes 112. In the illustrated embodiment, the microchannel feed holes 112 extend in a substantially radial direction from the outer shroud component 106, and more specifically the plenum 108, toward the inner shroud component 102, and more specifically the plurality of microchannels 110. It is to be appreciated that the microchannel feed holes 112 may extend in alternative directions and may be aligned at angles, for example, in various configurations. Irrespective of the precise alignment of the plurality of microchannel feed holes 112, the cooling fluid or airstream is directed to the plurality of microchannels 110 formed in the inner shroud component 102 for cooling purposes. The plurality of microchannels 110 extend along at least a portion of the inner shroud component 102, and typically along the inner surface 104. Alignment of the plurality of microchannels 110 may be in various directions, including axially and circumferentially, or combinations thereof, with respect to the gas turbine system 10, for example. The plurality of microchannels 110 are disposed along the inner surface 104 based on the proximity to the hot gas path, which is particularly susceptible to the issues discussed above associated with relatively hot material temperature. Although described in relation to a turbine shroud, it is to be understood that various other turbine components in close proximity to the hot gas path may benefit from such microchannels. Such components may include, but is not limited to, nozzles, buckets and diaphragms, in addition to the turbine shrouds discussed herein.

Accordingly, the plurality of microchannels 110 reduces the amount of compressed air used for cooling by improving cooling of the turbine shroud cooling assembly 100, particularly within the inner shroud component 102. As a result, an increased amount of compressed air is directed to the combustor 14 for conversion to mechanical output to improve overall performance and efficiency of the gas turbine system 10, while extending turbine component life by reducing thermal fatigue. Additionally, the direct, tight alignment of the inner shroud component 102 with the outer shroud component 106 reduces shifting and thermal growth at different rates of the inner shroud component 102 and the outer shroud component 106, which reduces leakage of the cooling fluid to the hot gas path.

Figure 4:
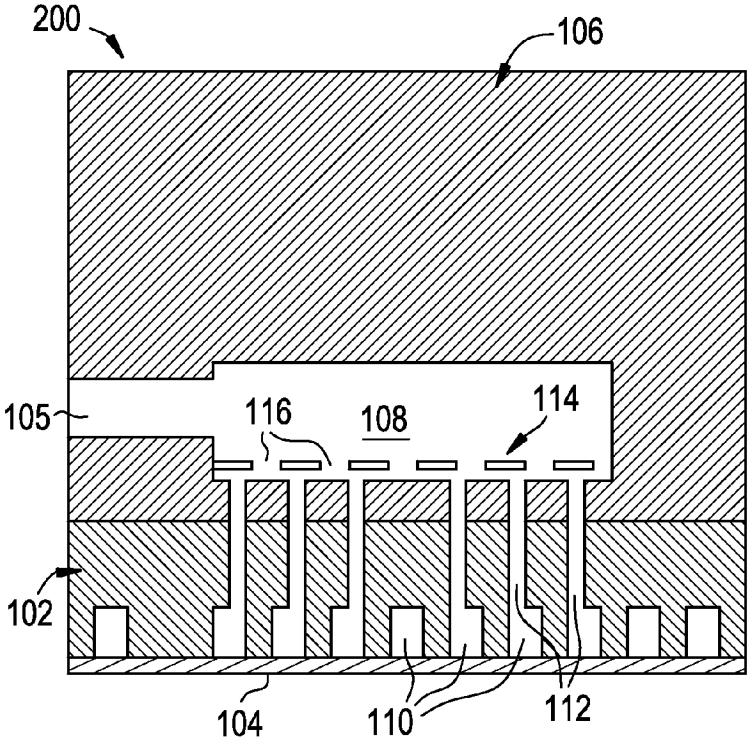
FIG. 4 is a turbine shroud cooling assembly of a second embodiment.

Referring now to FIG. 4, a second embodiment of the turbine shroud cooling assembly 200 is shown. The illustrated embodiment, as well as additional embodiments described below, includes similar features as that of the first embodiment described in detail above and will not be repeated in detail, except where necessary. Furthermore, as is the case with additional embodiments described below, similar reference numerals will be employed. The plurality of microchannel feed holes 112 are formed in both the outer shroud component 106 and the inner shroud component 102, such that holes line up correspondingly to form the plurality of microchannel feed holes 112, which lead to the plurality of microchannels 110. In an embodiment employing the impingement plate 114, impingement of the cooling fluid, or airstream, is imparted onto the outer shroud component 106, in conjunction with impingement toward the plurality of microchannel feed holes 112. Such a configuration enhances cooling of the outer shroud component 106, while also effectively cooling the inner shroud component 102.

Figure 5:
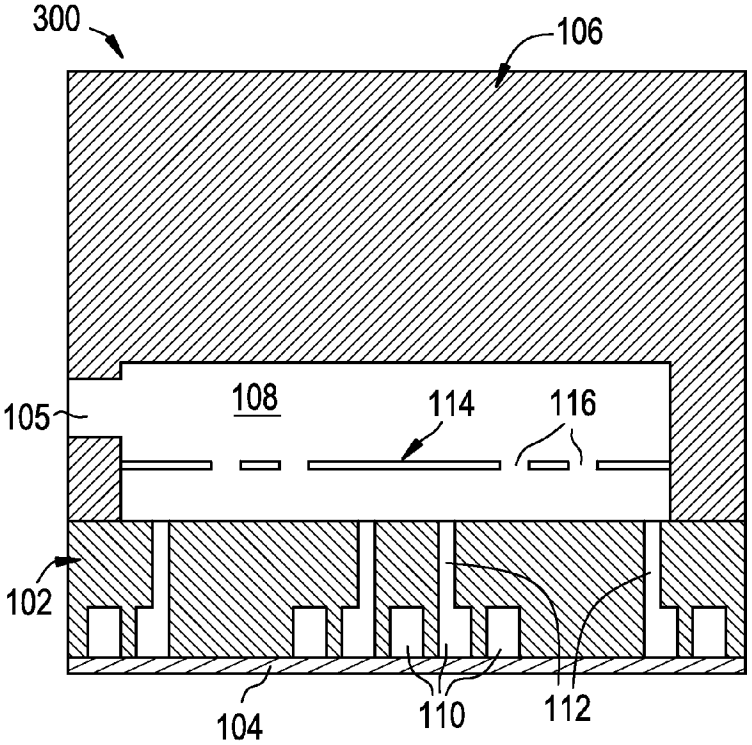
FIG. 5 is a turbine shroud cooling assembly of a third embodiment.

Referring now to FIG. 5, a third embodiment of the turbine shroud cooling assembly 300 is shown. The third embodiment focuses zones of impingement on areas that lack the plurality of microchannel feed holes 112. This is accomplished by misaligning the plurality of perforations 116 of the impingement plate 114 with the plurality of microchannel feed holes 112.

Figure 6:
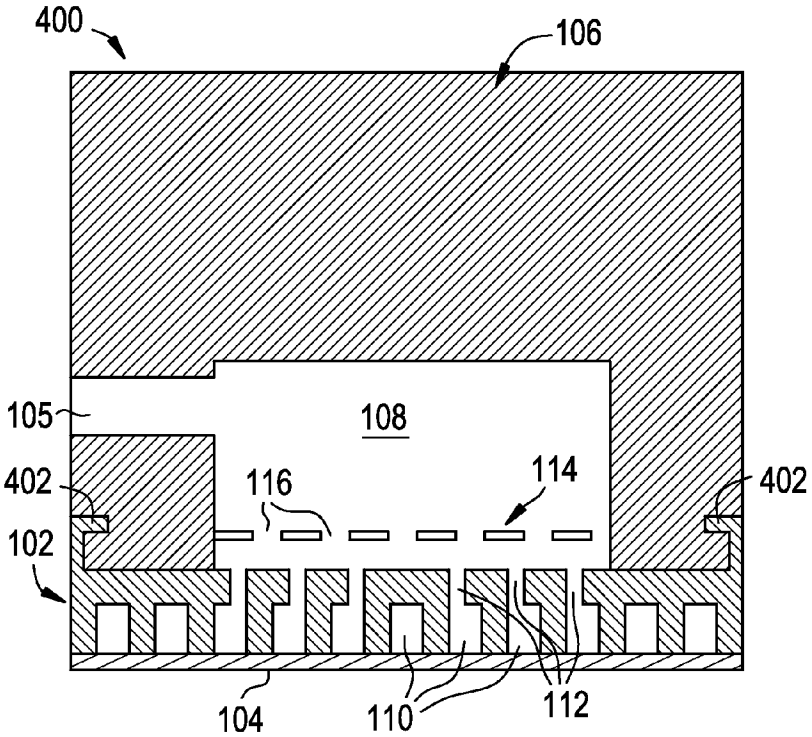
FIG. 6 is a turbine shroud cooling assembly of a fourth embodiment.

Referring now to FIG. 6, a fourth embodiment of the turbine shroud cooling assembly 400 is shown. The fourth embodiment includes at least one secondary attachment fastener 402 that functions as an additional attachment feature for securing the inner shroud component 102 to the outer shroud component 106. The secondary attachment fastener 402 is disposed on the inner shroud component 102 and comprises hooks, clips, or the like to engage the outer shroud component 106. In the event that primary attachments employed to fixedly connect the inner shroud component 102 to the outer shroud component 106 fail, the second attachment fastener 402 maintains the operable connection.

Figure 7:
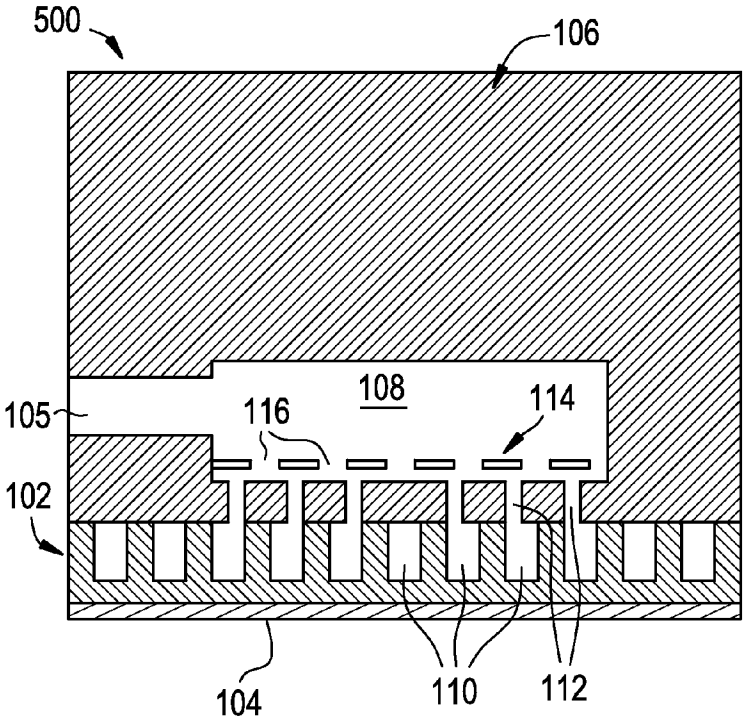
FIG. 7 is a turbine shroud cooling assembly of a fifth embodiment.

Referring now to FIG. 7, a fifth embodiment of the turbine shroud cooling assembly 500 is shown. The plurality of microchannel feed holes 112 are included along a radially outer side of the inner shroud component 102 and brazed material between the inner shroud component 102 and the outer shroud component 106 forms a seal to close the plurality of microchannels 110.

With respect to all of the embodiments described above, the plurality of microchannels 110 may be formed by any suitable method, such as by investment casting during formation of the inner shroud component 102. Another exemplary technique to form the plurality of microchannels 110 includes removing material from the inner shroud component 102 after it has been formed. Removal of material to form the plurality of microchannels 110 may include any suitable method, such as by using a water jet, a mill, a laser, electric discharge machining, any combination thereof or other suitable machining or etching process. By employing the removal process, complex and intricate patterns may be used to form the plurality of microchannels 110 based on component geometry and other application specific factors, thereby improving cooling abilities for the hot gas path component, such as the turbine shroud cooling assembly 100. In addition, any number of the plurality of microchannels may be formed in the inner shroud component 102, and conceivably the outer shroud component 106, depending on desired cooling performances and other application constraints.

The plurality of microchannels 110 may be the same or different in size or shape from each other. In accordance with certain embodiments, the plurality of microchannels 110 may have widths between approximately 100 microns (μm) and 3 millimeters (mm) and depths between approximately 100 μm and 3 mm, as will be discussed below. For example, the plurality of microchannels 110 may have widths and/or depths between approximately 150 μm and 1.5 mm, between approximately 250 μm and 1.25 mm, or between approximately 300 μm and 1 mm. In certain embodiments, the microchannels may have widths and/or depths less than approximately 50, 100, 150, 200, 250, 300, 350, 400, 450, 500, 600, 700, or 750 μm. While illustrated as square or rectangular in cross-section, the plurality of microchannels 110 may be any shape that may be formed using grooving, etching, or similar techniques. Indeed, the plurality of microchannels 110 may have circular, semi-circular, curved, or triangular, rhomboidal cross-sections in addition to or in lieu of the square or rectangular cross-sections as illustrated. The width and depth could vary throughout its length. Therefore, the disclosed flats, slots, grooves, or recesses may have straight or curved geometries consistent with such cross-sections. Moreover, in certain embodiments, the microchannels may have varying cross-sectional areas. Heat transfer enhancements such as turbulators or dimples may be installed in the microchannels as well.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine shroud cooling assembly for a gas turbine system comprising:

an outer shroud component disposed within a turbine section of the gas turbine system and proximate a turbine section casing, wherein the outer shroud component includes at least one airway for ingesting an airstream;

an inner shroud component disposed radially inward of, and directly bonded to, the outer shroud component, wherein the inner shroud component includes a plurality of microchannels extending in at least one of a circumferential direction and an axial direction for cooling the inner shroud component with the airstream from the at least one airway; and a cover disposed proximate an inner surface of the inner shroud component, the cover enclosing and sealing the plurality of microchannels from a hot gas path of the gas turbine system, the cover directly defining a radially inner end of the plurality of microchannels, wherein the cover includes a layer proximate the plurality of microchannels comprising a thermal barrier coating having a thickness ranging from 0.4 mm to 1.5 mm.

2. The turbine shroud cooling assembly of claim 1, wherein the outer shroud component comprises a first material and the inner shroud component comprises a second material.

3. The turbine shroud cooling assembly of claim 1, wherein the outer shroud component and the inner shroud component are formed of a single material.

4. The turbine shroud cooling assembly of claim 1, further comprising a plurality of microchannel feed holes formed within the inner shroud component, wherein the plurality of microchannel feed holes route the airstream to the plurality of micro channels.

5. The turbine shroud cooling assembly of claim 4, further comprising an impingement plate having a plurality of perforations for directing the airstream toward the plurality of microchannels.

6. The turbine shroud cooling assembly of claim 1, further comprising a secondary attachment feature for operably connecting the inner shroud component to the outer shroud component.

7. A turbine shroud cooling assembly for a gas turbine system comprising:

an outer shroud component disposed within a turbine section of the gas turbine system and proximate a turbine section casing;

an inner shroud component disposed radially inward of, and directly bonded to, the outer shroud component, wherein the inner shroud component includes a plurality of microchannels, wherein the outer shroud component and the inner shroud component are formed of a single material;

an impingement plate having a plurality of perforations for directing air toward the plurality of micro channels; and a cover disposed proximate an inner surface of the inner shroud component, the cover enclosing and sealing the plurality of microchannels from a hot gas path of the gas turbine system, the cover directly defining a radially inner end of the plurality of microchannels, wherein the cover includes a layer proximate the plurality of microchannels comprising a thermal barrier coating having a thickness ranging from 0.4 mm to 1.5 mm.

8. The turbine shroud cooling assembly of claim 7, wherein the outer shroud component and the inner shroud component are integrally formed as a unitary, solid component.

9. The turbine shroud cooling assembly of claim 7, wherein the plurality of microchannels extend in at least one of a circumferential direction and an axial direction.

10. The turbine shroud cooling assembly of claim 9, further comprising a plurality of microchannel feed holes formed within the inner shroud component, wherein the plurality of microchannel feed holes are aligned with the plurality of micro channels.

11. The turbine shroud cooling assembly of claim 10, wherein the plurality of perforations are misaligned with the plurality of microchannel feed holes.

12. The turbine shroud cooling assembly of claim 7, wherein the outer shroud component includes at least one airway for ingesting an airstream.

13. The turbine shroud cooling assembly of claim 7, further comprising a secondary attachment feature for operably connecting the inner shroud component to the outer shroud component.

14. A turbine shroud cooling assembly for a gas turbine system comprising:

an outer shroud component disposed within a turbine section of the gas turbine system and proximate a turbine section casing;

an inner shroud component disposed radially inward of, and fixedly connected to, the outer shroud component, wherein the inner shroud component includes a plurality of microchannels for cooling the inner shroud component;

an impingement plate having a plurality of perforations for directing air toward the plurality of micro channels; and a cover disposed proximate an inner surface of the inner shroud component, the cover enclosing and sealing the plurality of microchannels from a hot gas path of the gas turbine system, the cover directly defining a radially inner end of the plurality of microchannels, wherein the cover includes a layer proximate the plurality of microchannels comprising a thermal barrier coating having a thickness ranging from 0.4 mm to 1.5 mm.

15. The turbine shroud cooling assembly of claim 14, wherein the outer shroud component comprises a first material and the inner shroud component comprises a second material.

16. The turbine shroud cooling assembly of claim 14, further comprising a plurality of microchannel feed holes formed within the inner shroud component, wherein the plurality of perforations of the impingement plate are misaligned with the plurality of microchannel feed holes.

* * * * *